US005666609A

United States Patent [19]

Aoki

[11] Patent Number: 5,666,609

[45] Date of Patent: Sep. 9, 1997

[54] COPYING MACHINE AND METHOD FOR COPYING A DESIGNATED AREA OF AN ORIGINAL DOCUMENT

[75] Inventor: Minoru Aoki, Kawasaki, Japan

[73] Assignee: Ricoh Co., Ltd., Tokyo, Japan

[21] Appl. No.: 670,572

[22] Filed: Jun. 26, 1996

[30] Foreign Application Priority Data

Jun. 26, 1995 [JP] Japan ..... 7-159073

[51] Int. Cl.[6] ..... G03G 21/00

[52] U.S. Cl. ..... 399/183; 399/215

[58] Field of Search ..... 355/183, 205, 355/208, 182, 203, 375, 215

[56] References Cited

U.S. PATENT DOCUMENTS 4,666,288 5/1987 Watanabe ..... 399/183

FOREIGN PATENT DOCUMENTS 6-67497 3/1994 Japan .

*Primary Examiner*—Arthur T. Grimley
*Assistant Examiner*—Quana Grainger
*Attorney, Agent, or Firm*—Oblon, Spivak, McClelland, Maier & Neustadt, P.C.

[57] ABSTRACT

A copying machine and method for copying a designated area of an original document designates copying start and end positions. A controller controls partial copying in accordance with a first timing sequence corresponding to the copying start position and ends copying in accordance with a second timing sequence corresponding to the copying end position. If a repeat copying mode is prescribed, copying start and end positions which are designated in the first copying cycle are stored and used to make copies of a second and a set of following original documents. Thus, designation of copying start and end positions for subsequent copies is not necessary.

14 Claims, 12 Drawing Sheets

COPYING MACHINE AND METHOD FOR COPYING A DESIGNATED AREA OF AN ORIGINAL DOCUMENT

BACKGROUND OF THE INVENTION

1. Field of the Invention

The present invention relates to a copying machine which is equipped with an original document feed-through scanning system and is capable of copying a designated area of an original document.

2. Discussion of the Background

There is a copying machine in which an exposure source for exposing an original document and an optical system for imaging the original document are fixed and an original document platen on which an original document is placed moves in order to scan the original document over the fixed exposure source. Since the original document platen moves during a copying operation, there is some apprehension regarding safety with this type of copying machine. Further, the maximum size of the original document which can be copied is limited, because there is some limitation in the size of the original document platen for the same movement and safety reasons.

Therefore, a copying machine in which an original document platen is fixed and an exposure source and a part of an optical system moves for scanning an original document has become popular particularly for the reason that there is no moving unit outside of the machine and that a relatively large original document can be copied.

However, with such a copying machine having a fixed original document platen, it is impossible to copy a whole surface or a part of a lengthy original document, such as for example, a computer output form which is folded, onto a single copysheet with a corresponding length. Consequently, copying is performed in pieces by placing the original document on the original document platen so that a part to be copied is placed at a predetermined position on the original document platen and thus this part is copied onto a standard size copysheet. The original document is then repositioned and another part of the original document is copied to a second sheet of the standard size. This process repeats until the entire original document is copied to a set of standard sized sheets.

In practice, however, it is rather difficult to place a part of an original document at a predetermined position precisely because an original document needs to be placed with a surface to be copied facing the original document platen and thus an operator cannot precisely see how the original document aligns with the original document platen.

There is proposed in Japanese laid open publication 3-44294 an example of a copying machine in which an exposure source, which normally stays at a fixed position, is made to move to a predetermined position for exposing an original document which is transported over that position by means of an original document feeder. Further, this publication proposes to copy a part of a lengthy original document by first starting transport of an original document with depression of a "start" button and then, starting a copying operation with depression of a "copying start" button precisely when a desired part of the original document reaches a position identified by a pointer on the copying machine.

However, with the above arrangement, if an original document is fed with a surface to be copied facing downwards it is impossible for an operator to determine when the part to be copied reaches the pointer. Consequently, when to start a copying operation cannot be determined with any degree of accuracy. Therefore, generally, a mark is put on the back side of an original document at a position corresponding to a leading edge of a part to be copied. The operator depresses the copying start button when the mark reaches a predetermined position thereby improving copying accuracy. It is time-consuming, however, to put such a mark on an original document, especially when the volume of copying is large. Further, copying accuracy may be jeopardized by a risk that a mark is put in a wrong position. Accordingly, this copying approach is suboptimal because it is manually intensive and subject to copying inaccuracies.

When copying a designated area of each of a plurality of original documents each having a designated area at an identical position to the other original documents, it is troublesome to depress a copying start button at precisely the correct time for each of the plurality of original documents.

Further, if a speed of original document transport is as fast as 20–30 cm/sec, for example, as in most modern copying machines, it is almost impossible to designate a copying start position precisely. Even with a copying machine with a speed of 2–3 cm/sec, it is rather difficult to designate a copying start position precisely. Furthermore, a copy machine with such a slow speed is not suitable for practical use.

SUMMARY OF THE INVENTION

The present invention has been made in view of such problems and to address and resolve these problems. Accordingly, an object of the present invention is to provide a novel copying machine capable of making, in a simple manner, multiple copies of a designated area of an original document, and also, copying a designated area of each of a plurality of original documents having common designated areas.

In order to achieve the above-mentioned first object, a copying machine with an original document feed-through scanning system, includes an original document transport device to transport an original document through an exposure position, a partial copying mode prescribing device to prescribe a partial copying mode to copy a designated area of an original document, a repeat copying mode prescribing device to prescribe a repeat copying mode to repeat copying with the same conditions for a plurality of original documents, and a copying start position designating device to enable an operator to designate a copying start position when an original document being transported by the original document transport device reaches a predetermined position.

The copying machine also includes a copying end position designating device to enable an operator to designate a copying end position when an original document being transported by the original document transport device reaches a predetermined position, a copying position memory device to memorize a copying start position designated by the copying start position designating device and a copying end position designated by the copying end position designating device, and a partial copying control device to start copying a first original document in accordance with a timing corresponding to a timing of designation made through the copying start position designating device and end copying in accordance with a timing corresponding to a timing of designation made through said copying end position designating device. Furthermore, a repeat copying mode is prescribed by the repeat copying mode prescribing device and starts copying a second and the following original documents in accordance with a timing sequence corresponding to a copying start position read out from the copying position memory device and end copying in accordance with a timing sequence corresponding to a copying end position read out from the copying position memory device.

Another object of the present invention is to provide a novel copying machine and method capable of designating a copying start or end position precisely and in an easy manner.

Further, in order to achieve the second object, the copying machine as mentioned above includes a guide member, provided in the upper stream of an original document transport direction relative to the exposure position, to indicate a predetermined position for making designation of copying start and end positions through the copying start position designating device and the copying end position designating device respectively, and the original document transport device transports an original document with a surface to be copied facing upwards when the original document passes under the guide member.

A further object of the copying machine is to transport an original document in such way that a surface to be copied is made visible from outside and to an operator when the original document passes the predetermined position.

Yet a further object of the copying machine is to provide a copying position designation mode prescribing device that prescribes a copying position designation mode which lowers an original document transport speed of the original document transport device to a speed slower than a speed of a normal copying operation.

Still a further object is to provide a copying machine that includes a copying position designation mode clearing device that clears a copying position designation mode in accordance with a designation of a copying end position through the copying end position designating device and restores an original document transport speed of the original document transport device to a speed of a normal copying operation.

Yet still a further object of the copying machine is to include a detect device to detect a trailing edge of an original document being transported by the original document transport device and a copying position designation mode clearing device to clear a copying position designation mode in accordance with a timing sequence of detecting a trailing edge of an original document with the detect device.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
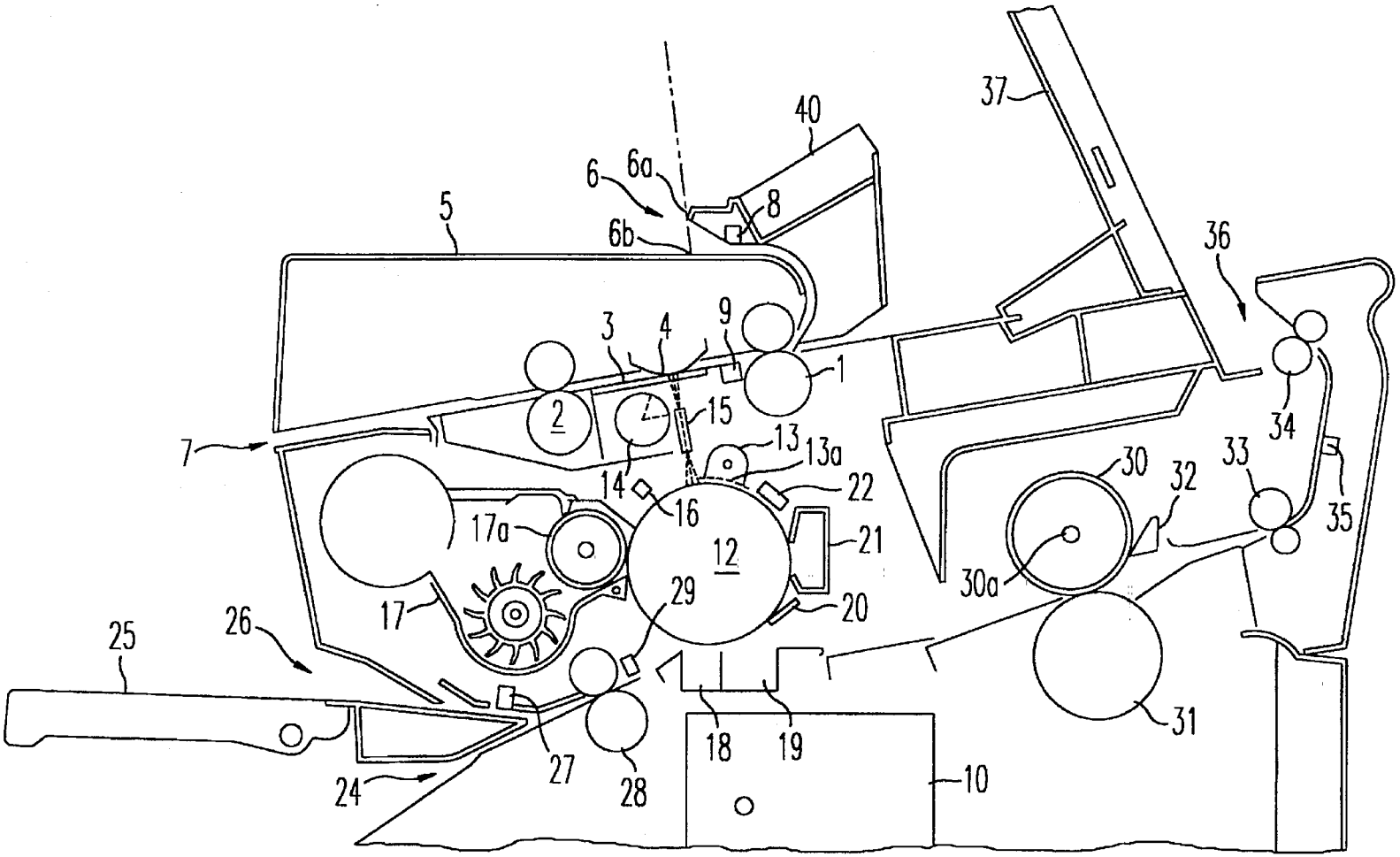
FIG. 1 is a schematic drawing illustrating an example of an internal structure of a copying machine according to the present invention.

Referring now to the drawings, wherein like reference numerals designate identical or corresponding parts throughout the several views, embodiments of the present invention are explained hereinbelow.

FIG. 1 is a schematic drawing illustrating an example of an internal structure of a copying machine with an original document feed-through scanning system according to the present invention.

The copying machine shown in FIG. 1 is constructed from an original document transport unit (elements 1–9), an image forming unit (elements 12–22), a copysheet transport unit (elements 24–37), an operational panel unit 40 and a main motor 10 which drives these units.

The original document transport unit includes a first pair and a second pair of original document feeding rollers 1 and 2 respectively as original document transport means, a contact glass 3, a pressuring cover 4 having a white surface for pressing lightly an original document to the contact glass 3, an original document table 5 for placing thereupon an original document, an original document inlet 6, an original document outlet 7, an original document inlet sensor 8 which is provided near the original document inlet 6 for detecting a leading edge and a trailing edge of an original document which is inserted into the original document inlet 6, an original document registration sensor 9 which is provided immediately after the first pair of original document feeding rollers 1 for detecting transport of the original document and guides for guiding the original document to be transported.

The image forming unit includes a photoconductor drum 12 rotating counterclockwise, a charger 13 that includes a scorotron charger to charge a surface of the photoconductor drum 12, an exposure lamp 14 as an exposure source to expose a surface of an original document, a lens array 15 to project an image of an original document which is exposed by the exposure lamp 14 onto a surface of the photoconductor drum 12, an eraser 16 to partially erase a latent image which is formed on a surface of the photoconductor drum 12, a developing unit 17 having a developing sleeve 17*a* to convert a latent image on the photoconductor drum 12 into a toner image, a transfer charger 18 to transfer a toner image on the photoconductor drum 12 onto a copysheet, a separating charger 19 to separate a copysheet from the photoconductor drum 12, a separating claw 20, a cleaner 21 to remove toner and electric charge remaining on a surface of the photoconductor drum 12 and a discharge lamp 22.

The first half of the copysheet transport unit includes a copysheet inlet 24 through which a copysheet is fed in from an automatic copysheet (e.g., paper) feeder (hereinafter referred to as APF) which is an optional device and is not included in the drawings, a copysheet table 25 to place thereupon a copysheet to feed in manually, a manual copysheet inlet 26, a manual copysheet inlet sensor 27 which is provided near the manual copysheet inlet 26 to detect a leading edge and a trailing edge of a copysheet which is inserted into the manual copysheet inlet 26, a pair of copysheet registration rollers 28 to stop transport of a copysheet temporarily and feed the copysheet according to a certain timing sequence and a copysheet registration sensor 29 which is provided immediately following the pair of copysheet registration rollers 28.

The latter half of the copysheet transport unit includes a fixing roller 30 which is heated to fix a toner image carried on a copysheet onto the copysheet, a pressure roller 31, a separating claw 32 to separate the copysheet from the fixing roller 30, a first pair and a second pair of copysheet exiting rollers 33 and 34 respectively to exit the copysheet, a copysheet exit sensor 35 which is provided between the first and the second pairs of copysheet exiting rollers 33 and 34 respectively, a stacker 37 to stack thereupon the copysheet, and guides to guide the copysheet.

Figure 2:
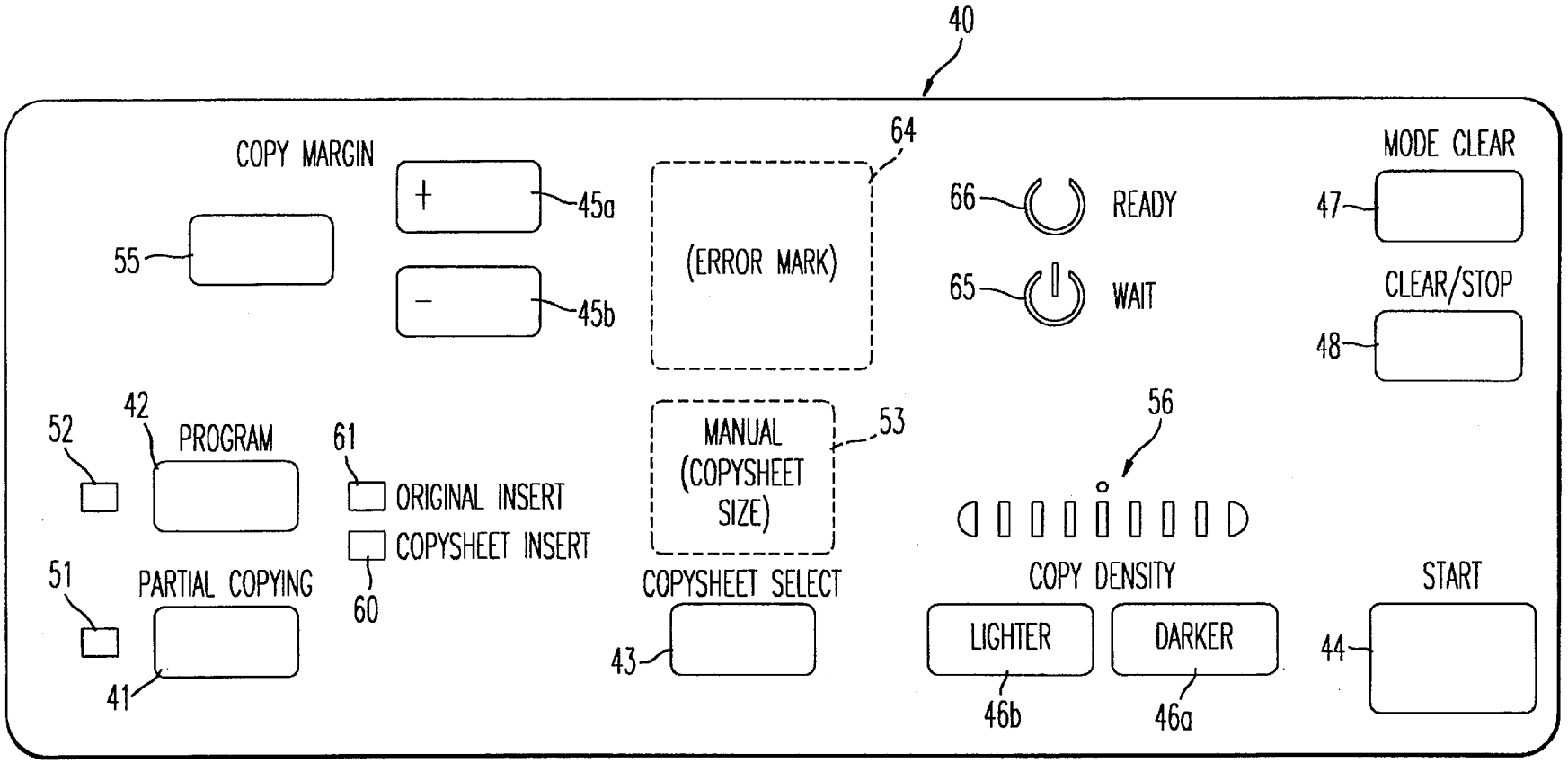
FIG. 2 is a plan view of an example of an operational panel of the,copying machine shown in FIG. 1.

FIG. 2 is a plan view of an example of an operational panel 40 which constitutes the operational panel unit shown in FIG. 1. The operational panel 40 includes an operational instruction input unit (elements 41–48) which includes various keys for an operator to input various instructions and a display unit including a light emitting diode (LED), a display or the like to indicate a condition, a mode and a designated operation of the machine.

The operational instruction input unit of the operational panel 40 shown in FIG. 2 includes a partial copying key 41 and a program key 42 according to the present invention, a copysheet select key 43 to manipulate when an APF is installed, a start key 44 to start copying, copy margin keys 45*a* and 45*b* to specify a margin of a copy, copy density keys 46*a* and 46*b* to select a copy density of the copy, a mode clear key 47 to clear all modes which are prescribed to return to an initial mode, a clear and stop key 48 to stop copying and initialize the machine when an error occurs.

The display unit of the operational panel 40 includes a partial copying mode indicator LED 51 and a program mode indicator LED 52 which includes a bi-color LED which lights in red or green (or in yellow when both light at the same time), a copysheet display 53 (preferably a liquid crystal display LCD) to display by means of a mark and alphanumeric characters a size and a feeding direction of a manually fed copysheet or a selected copysheet, a copy margin display 55 (preferably LCD) to display by means of numerals a dimension of a margin designated via the copy margin keys 45*a* and 45*b*, and a copy density indicator 56 to indicate a copy density designated via the copy density keys 46*a* and 46*b*.

Further, the display unit includes a copysheet insertion indicator LED 60 to indicate by lighting that the machine is ready for accepting a copysheet, an original document insertion indicator LED 61 to light to indicate that the machine is ready for accepting an original document, an error message display 64 to display via a corresponding mark a cause of an error which has occurred, such as, for example, copysheet jam, toner shortage and so forth, and a wait state indicator 65 to indicate by lighting, when the machine is turned on, that the machine is not ready for copying, and a ready state indicator 66 to indicate by lighting, when the machine is turned on, that the machine is ready for copying.

Figure 3:
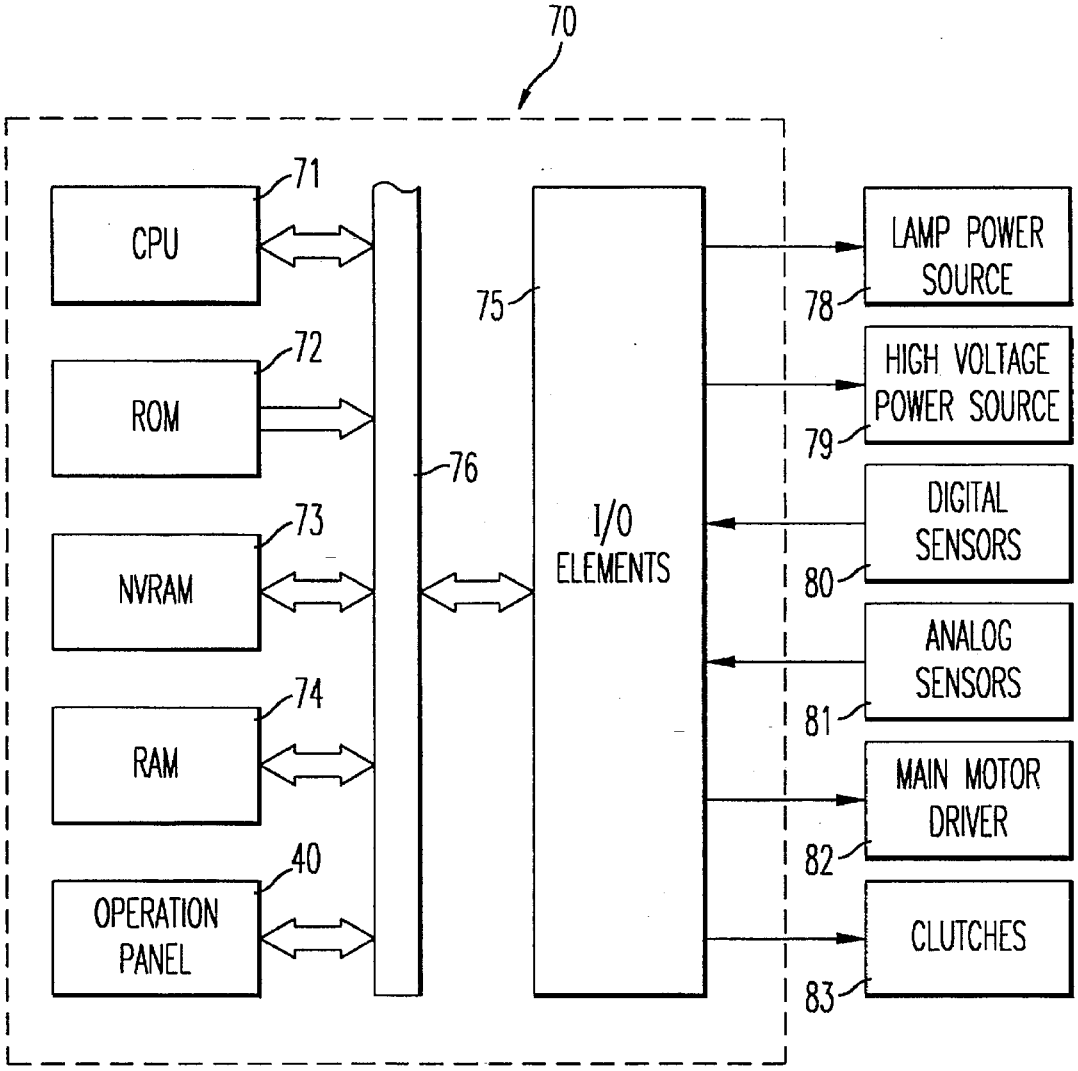
FIG. 3 is a functional block diagram illustrating an example of a structure of a control system of the copying machine shown in FIG. 1.

FIG. 3 is a functional block diagram illustrating an example of a structure of a control system of the copying machine shown in FIG. 1.

A control circuit 70 shown in FIG. 3 includes a CPU 71 to perform sequence and process control of the machine, a ROM 72 to store programs and fixed data to be used by the CPU 71, a NVRAM (nonvolatile RAM) 73 to store administrative data, a RAM 74 to store variable data and mode flag, I/O element 75 and the operational panel 40, and these elements are connected via a bus 76.

A lamp power source 78 connects to the I/O element 75. Lamp power source 78 turns on and off the exposure lamp 14, the eraser 16 and the discharge lamp 22, in accordance with a corresponding signal from the CPU 71. Further, a high voltage power source 79 is connected to the I/O element 75. The power source 79 turns on and off the charger 13, the transfer charger 18 and the separation charger 19, and changes a grid voltage and a developing bias voltage to be applied to a grid 13*a* of the charger 13 and the developing sleeve 17*a* of the developing unit 17 respectively.

A series of digital sensors 80 are connected to I/O elements 75. Such sensors include the original document inlet sensor 8, the original document registration sensor 27, the copysheet registration sensor 29 and the copysheet exit sensor 35, each of which output respective detect signals for sequence control, and a series of analog sensors 81 to detect quantity of light from the exposure lamp 14 and surface temperature of the fixing roller 30 to output detect signals for process control.

Further, a main motor drive circuit 82 to drive and stop the main motor 10 in accordance with a respective timing signal from the CPU 71 and a series of clutches 83 to transmit a driving force from the main motor 10 to each operating element of the machine are connected to the I/O element 75.

Under the control CPU 71, when a power source switch of the copying machine, which is not shown in the drawings, is turned on, the wait state indicator 65 of the operational panel 40 is lighted. Then, after initialization is completed, and when the temperature of the fixing roller 30 reaches a prescribed temperature, the wait state indicator 65 turns off and the ready state indicator 66 turns on. At the same time, the copysheet display 53 displays a message indicating a manual copysheet insertion mode, which is prescribed as an initial mode, and a mark positioned in the center of the copy density indicator 56 is lighted, which is also prescribed as an initial mode, and the copysheet insertion indicator LED 60 lights indicating that the machine is ready for accepting a copysheet.

If an APF is not installed, information content displayed in the copysheet display 53 does not change even if the copysheet select key 43 is depressed. However, if an APF is installed, the information content displayed in the copysheet display 53 changes in accordance with depression of the copysheet select key 43, and the display 53 indicates a size and a feeding direction (lengthwise or sideways) of each copysheet included in the APF cyclically via corresponding words, such as A3, B4 and A4, and corresponding marks for respective copysheet transport directions, including a manual copysheet insertion mode.

When the copy margin copy key 45*a* or 45*b* is depressed, the copy margin display 55 indicates a dimension, with a plus (+) mark or a minus (–) mark, in a unit of, for example, 2 mm or 5 mm. When the copy density key 46*a* or 46*b* is depressed, a position of a mark which is lighted moves in a unit of one step towards right, indicating that density of a copy becomes darker, or towards left, indicating that density of a copy becomes lighter.

Hereinafter, a dimension of a side of the copysheet, the original document or the copy area of the original document, which is in parallel with a transport direction of the copysheet, the original document or the copy area of the original document is referred to as a length, and a dimension of a side, which is at a right angle to the length side, is referred to as a width. Further, in a case that a transport direction of the copysheet, the original document or the copy area of an original document is upwards in the drawings, an upper side and a lower side of the copysheet, the original document or the copy area of the original document are referred to as a leading edge and a trailing edge respectively.

Now, in reference to FIGS. 1, 2 and 3. an operation of the machine is explained with respect to a case of copying a whole surface of an original document by manually inserting a copysheet, which is the same size as the original document and is fed in the same transport direction as the original document. Hereinafter, an operation of copying a whole surface of an original document is referred to as full copying and an operation of copying a part of an original document is referred to as partial copying.

In a case of full copying, no operation is necessary on the operational panel 40 for starting a copying operation, if the machine is in an initial mode or in a state where the machine has returned to an initial mode by depressing the mode clear key 47.

After confirming that the copysheet insertion indicator LED 60 is lighted and placing a copysheet on the copysheet table 25, if a copysheet is inserted into the copysheet inlet 26, the copysheet inlet sensor 27 detects a leading edge of the copysheet and the pair of copysheet registration rollers 28 start to rotate. When a leading edge of the copysheet reaches the pair of copysheet registration rollers 28 and is nipped by the rollers 28, the copysheet registration sensor 29 detects the leading edge of the copysheet and outputs a detect signal.

In accordance with the above-mentioned detect signal, the pair of the copysheet registration rollers 28 stop rotating and the copysheet is put in a waiting state for transport, and at the same time, the first and the second pairs of original document feeding rollers 1 and 2 start to rotate to be in a ready state for transporting an original document, the copysheet insertion indicator LED 60 is turned off, and the original document insertion indicator LED 61 lights indicating that an original document can be inserted.

After confirming that the original document insertion indicator LED 61 is on, if an original document is inserted into the original document inlet 6 with the image carrying surface facing upwards, a leading edge of the original document is detected by the original document inlet sensor 8, and then reaches, guided by the guides 6*a* of inlet 6, the first pairs of original feeding rollers 1, and the original document starts to be transported at a prescribed transport speed.

If the original registration sensor 9 detects a leading edge of an original document, thus confirming a start of original document transport, the original document insertion indicator LED 61 is turned off, and operation of the image forming unit and the copysheet transport unit thereafter is controlled respectively in accordance with a respective timing sequence which is determined in accordance with a timing sequence of an output signal of the original registration sensor 9.

Namely, in accordance with a detect signal from the original registration sensor 9 confirming the start of original document transport, a grid voltage applied to the grid 13*a* of the charger 13 is changed, for example, from 0 to –950 V, the charger 13 starts charging a surface of the photoconductor drum 12 which rotates at the same speed as the original document transport speed, the exposure lamp 14 and the eraser 16 both light, and the lens array 15 starts to project an image of a leading edge of an original document on a surface of the photoconductor drum 12.

When a part of a latent image on the photoconductor drum 12, corresponding to a leading edge of an original document, reaches a position facing the eraser 16, the eraser 16 is turned off, and then, when the same part reaches a position just before the developing unit 17, a bias voltage applied to the developing sleeve 17*a* is changed, for example, from –260 V which is a prescribed voltage for a waiting state, to –180 V which is a prescribed voltage for development, to start a developing process.

Then, the pair of copysheet registration rollers 28 start to feed a copysheet at such a timed speed that a leading edge of the copysheet registers with a leading edge of a developed image when the leading edge of the developed image reaches a position facing the transfer charger 18, and the transfer charger 18 and the separation charger 19 start charging at respective times such that the leading edge of the copysheet reaches the transfer charger 18 and the separation charger 19 respectively, and the copysheet is separated from the photoconductor drum 12 after the toner image is transferred onto the copysheet. The transfer claw 20 is provided for securing separation of the copysheet from the photoconductor drum 12.

After the toner image is transferred to the copysheet, residual toner on the photoconductor drum 12 is removed by the cleaner 21 and residual charge is erased by the eraser lamp 22. The photoconductor drum 12 is then charged again by the charger 13 for a next copying cycle.

A copysheet on which a toner image is transferred is transported, guided by the guides, to be pressed to the fixing roller 30 by the pressure roller 31, and the toner image is fixed on the copysheet by the fixing roller 30 which is heated by the heater 30*a*. The copysheet carrying a fixed toner image is separated from the fixing roller 30 by the separation claw 32 and then transported by the first and the second pairs of copysheet exit rollers 33 and 34 to exit from the copysheet outlet 36. The copysheet exit sensor 35 detects a leading edge of a copysheet at an intermediate position between the first pair of copysheet exist rollers 33 and the second pair of copysheet exit rollers 34 to confirm if the copysheet is exited safely without any trouble, such as jamming.

Just before the copying operation is completed, when the copysheet inlet sensor 27 detects a trailing edge of the copysheet or the original document registration sensor 9 detects a trailing edge of the original document, a grid voltage of the charger 13 returned to 0 volts to terminate charging, the exposure lamp 14 is turned off and the eraser 16 lights for a predetermined period of time to erase a latent image not corresponding to the original document.

Then, the developing bias voltage of the developing sleeve 17*a* returns to a waiting mode voltage −260 V to terminate development, and further, the transfer charger 18 and the separation charger 19 terminate charging when the trailing edge of the copysheet reaches respective positions facing the transfer charger 18 and the separation charger 19.

The original document is exited from the original document outlet 7 by the second pair of original document feeding rollers 2 when copying is Completed, and the copysheet which is passed through fixing is exited from the copysheet outlet 36 by the second pair of copysheet exit rollers 34.

Figure 4:
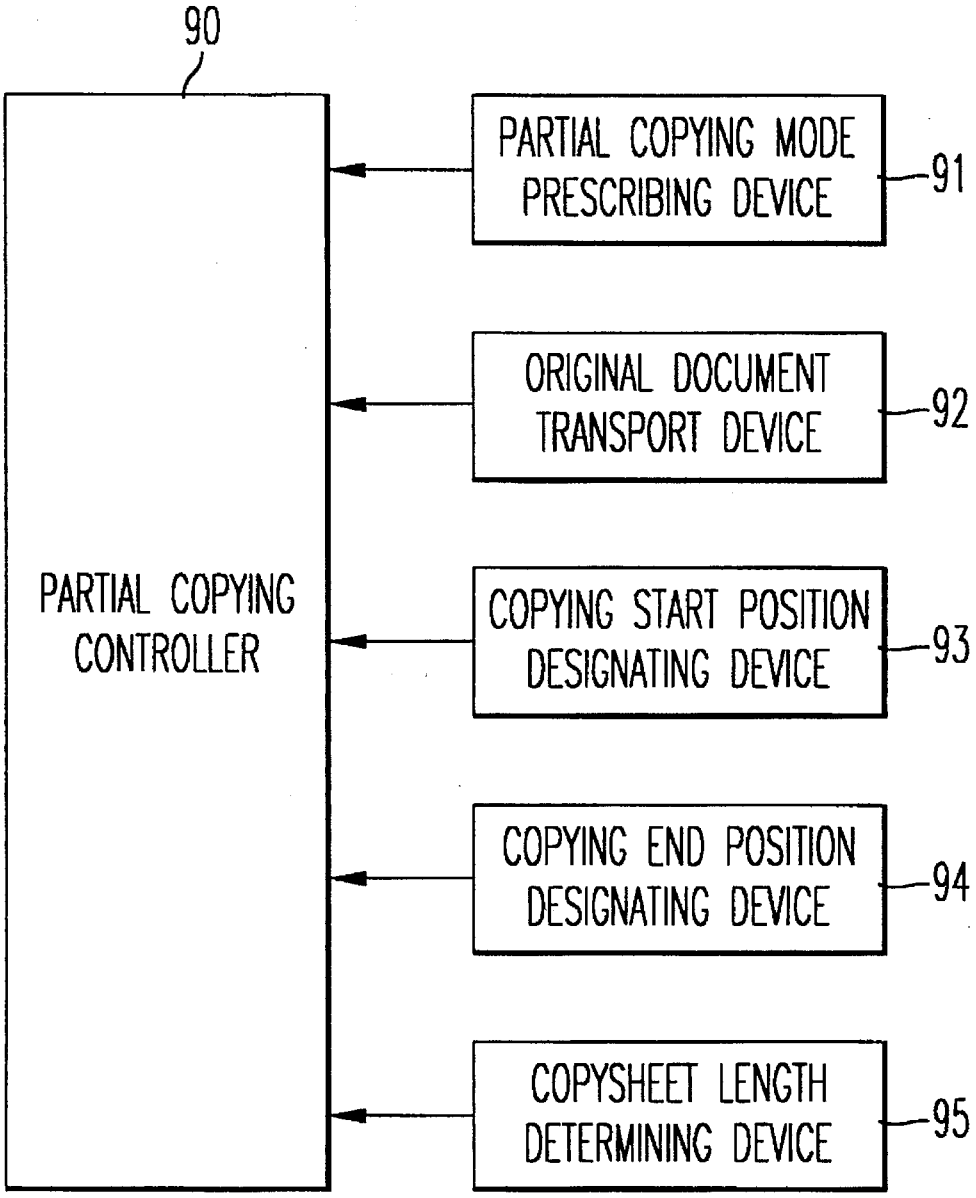
FIG. 4 is a functional block diagram illustrating an example of a structure of a first embodiment of a partial copying control system of the copying machine shown in FIG. 1.

FIG. 4 is a functional block diagram illustrating an example of a structure of a first embodiment of a partial copying control system of the copying machine shown in FIG. 1. As shown in FIG. 4, the partial copying control system includes a partial copying controller 90 (e.g., the CPU 71), a partial copying mode prescribing device 91, an original document transport device 92, a copying start position designating device 93, a copying end position designating device 94 and a copysheet length determining device 95.

If a partial copying mode is prescribed by means of the partial copying mode prescribing device 91, the partial copying controller 90, after confirming a start of transport of an original document with the original document transport device 92, which starts transport of an original document upon detecting a leading edge of a copysheet inserted into the copysheet inlet 26, waits for an input designating a copying start position from the copying start position designating device 93, and then starts copying in accordance with a timing sequence corresponding to a timing sequence from the copying start position designating device 93.

Further, the partial copying controller 90 determines if a length of an area which is designated by the copying start position designating device 93 and the copying end position designating device 94 is shorter than a length of the transported copysheet. If it is shorter, the partial copying controller 90 terminates the copying operation in accordance with the timing sequence of designating the copying end position with the copying end position designating device 94, and terminates copying in accordance with the timing sequence of detecting a trailing edge of the transported copysheet if the length of the transported copysheet is shorter. The length of the transported copysheet is determined by the copysheet length determining device based upon respective timing differentials between detecting a leading edge and a trailing edge of the copysheet.

In practice, the partial copying controller 90 may terminate the copying operation using the timing sequence of detecting the trailing edge of the copysheet or the timing sequence of detecting an input from the copying end position designating device 94 for designating a copying end position, whichever is earlier.

Figure 5:
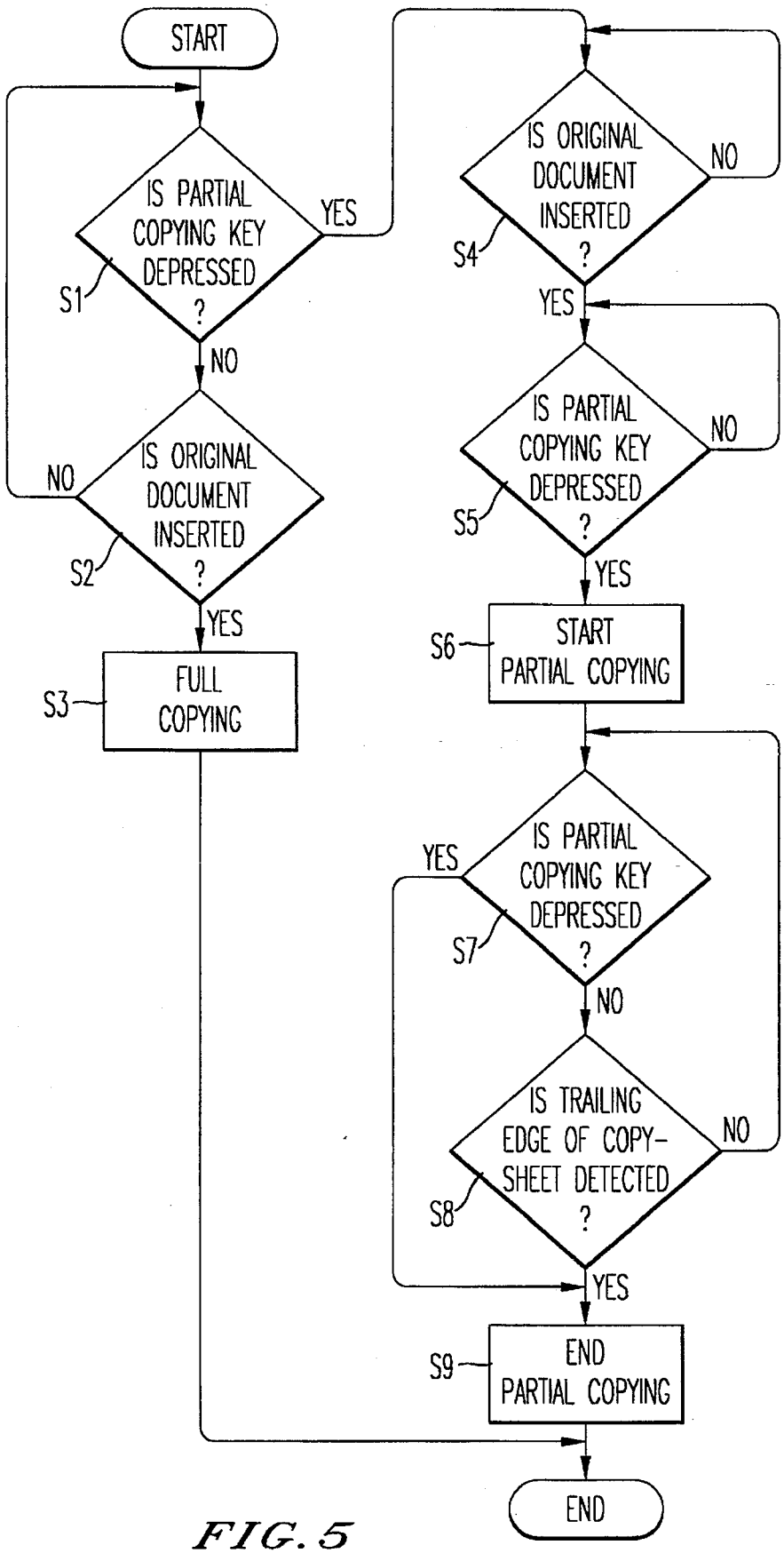
FIG. 5 is a flowchart illustrating an example of a process of partial copying performed by the first embodiment of the partial copying control system.

FIG. 5 is a flowchart illustrating an example of a process of partial copying performed by the CPU 71 (FIG. 3) as the partial copying controller 90.

Hereinbelow, an operation of the machine with respect to the present invention is explained more in detail in accordance with the flowchart shown in FIG. 5, referring also to FIGS. 1 through 3. In the explanation, operation of the original document transport unit, the image forming unit and the copysheet transport unit, which overlap with those in a case of full copying, are skipped.

In this example, the partial copying key 41 of the operational panel 40 (FIG. 2) is used as the partial copying mode prescribing device 91, the copying start position designating device 93 and the copying end position designating device 94.

If the partial copying key 41 is depressed when no original document is inserted, the key 41 functions as the partial copying mode prescribing device 91 and prescribes a partial copying mode, and the partial copying mode indicator LED 51 lights in red to indicate a partial copying mode.

If a partial copying mode has been prescribed and an original document is being transported, the partial copying key 41 functions as the copying start position designating device 93, and when depressed a first time, the partial copying mode indicator LED 51 changes to yellow indicating that a copying start position is designated. If the partial copying key 41 is depressed again while the partial copying key 41 lights in yellow, the partial copying key 41 functions as the copying end position designating device and the partial copying mode indicator LED 51 changes to green indicating that the copying end position is designated.

If the copysheet is inserted in this state, the leading edge of the copysheet is detected by the copysheet registration sensor 29, the copysheet indicator LED 60 is turned off, the first and second pairs of original document feeding rollers 1 and 2 as the original document transport device 92 start to rotate, the original document insertion indicator LED 61 lights, and then, the process shown in FIG. 5 starts.

First, a step S1 determines if the partial copying key 41 is depressed, and if the answer is negative, the process proceeds to a step S2 to determine if an original document is inserted and transported. If an original document is not inserted, the process returns to the step S1. If an original document is inserted and transported, namely, if an original document is inserted without depressing the partial copying key 41, the process proceeds to a step S3 to perform a process of full copying and jumps to the end of the process.

If the step S1 determines as that the partial copying key 41 is depressed, namely, if the partial copying key 41 is depressed before an original document is inserted, a partial copying mode is prescribed and the partial copying mode indicator 51 changes to red, and the process jumps to a step S4 to wait for insertion of an original document. If an original document is inserted and the transport starts, the process proceeds to a step S5 to wait for input from the partial copying key 41, namely input for designating a copying start position.

If the partial copying key 41 is depressed, namely if input for designating a copying start position is made, and the partial copying mode indicator LED 51 changes to yellow, the process proceeds to a step S6 to start a process of partial copying. Namely, each part of the image forming unit starts to operate in accordance with a timing corresponding to a timing of the designation of a copying start position, and the pair of copysheet registration rollers 28 of the copysheet transport unit start to feed a copysheet in accordance with a corresponding timing sequence.

Next, a step S7 determines if the partial copying key 41 is depressed a second time, namely if input for designating a copying end position is made, and if the answer is negative, the process proceeds to a step S8 to determine if the copysheet inlet sensor 27 has detected the trailing edge of the copysheet. If the answer is negative, the process returns to the step S7.

If an input is made designating a copying end position and the partial copying mode indicator 51 turns to green or the trailing edge of the copysheet is detected, while the steps S7 and S8 are being repeated, the process proceeds to a step S9 to terminate the operation of partial copying and change the partial copying mode indicator LED 51 to red, and the process ends.

Although the process shown in FIG. 5 illustrates a case that the process starts after a copysheet is inserted and the first and second pairs of original document feeding rollers 1 and 2 have started to rotate, the partial copying key 41 functions properly even before insertion of a copysheet if depression of the partial copying key 41 is made before an original document is inserted. Generally, when a key is depressed, a corresponding flag is raised, and therefore, the step 1 may be so made to determine if a flag for a partial copying mode is raised.

A partial copying mode is usually cleared via the mode clear key 47 which clears all modes. When the partial copying mode indicator LED 51 lights in red indicating that the mode is in a partial copying mode and an original document is not inserted, the partial copying key 41 functions to clear the partial copying mode. Therefore, even when the partial copying key 41 is depressed erroneously and a partial copying mode is prescribed erroneously, a partial copying mode can be cleared by depressing the partial copying key 41, without clearing other conditions of the machine, such as copy density and so forth, which are prescribed by the operator.

If an APF, which is not shown in FIG. 1, is installed, and the start key 44 is depressed after selecting a size and a feeding direction of the copysheet via the copysheet select key 43, the copysheet thus selected is fed out from the APF and is transported through the copysheet inlet 24 to the pair of copysheet registration rollers 28 which start in accordance with a feeding signal from the APF, and then, the copysheet registration sensor 29 detects the leading edge of the copysheet thus transported. Operations following detection of the leading edge of the copysheet are the same as those in a case that a copysheet is inserted manually.

When the copysheet is fed through the copysheet inlet 24, the copysheet inlet sensor 27 is unable to detect the trailing edge of the copysheet. However, a length of a copysheet being transported is known when the copysheet select key 43 is depressed, and therefore, there is no problem in determining the length of the transported copysheet, and consequently in determining the timing sequence for ending a copying operation.

Figure 6A:
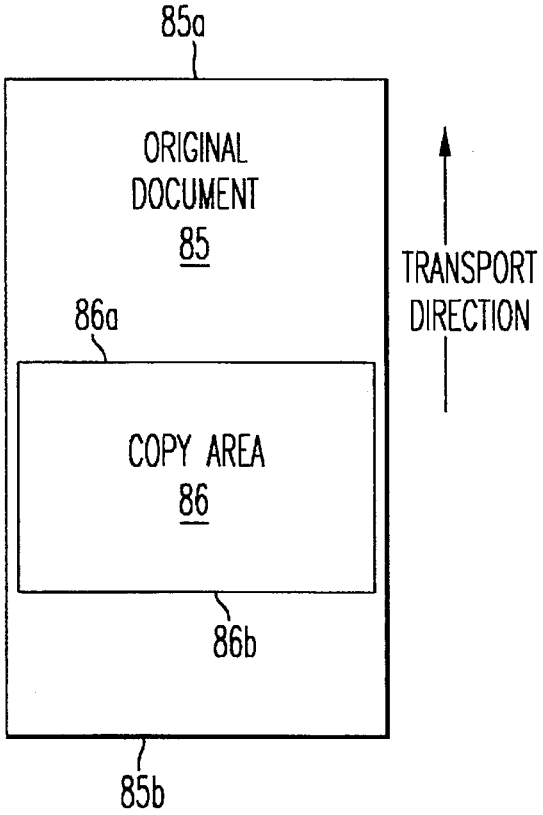
FIGS. 6(*a*) and 6(*b*) are plan views illustrating respectively an example of an area designated for copying in an original document.
Figure 6B:
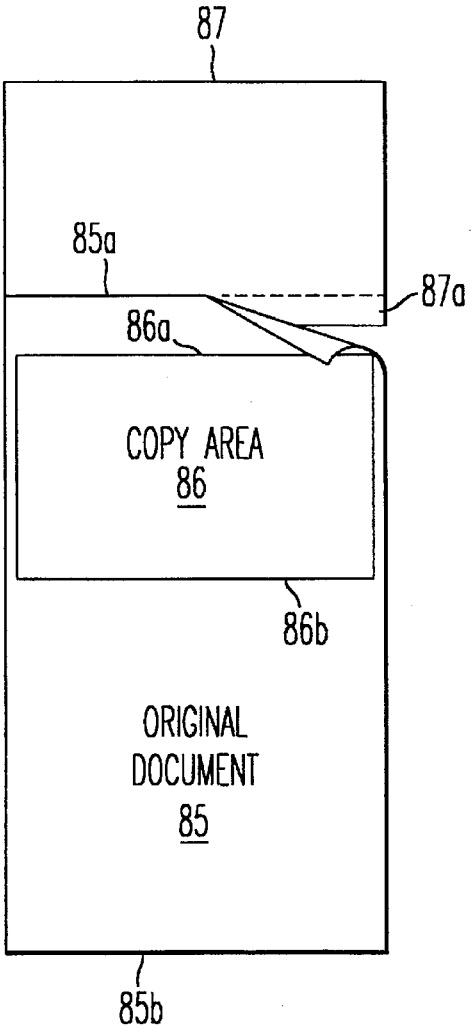

FIGS. 6(*a*) and 6(*b*) are plan views illustrating respectively an example of an area designated for copying (hereinafter referred to as a copy area) in an original document.

In FIG. 6(*a*), numeral 85*a* denotes the leading edge of the original document 85 which is transported in a direction indicated by the arrow in FIG. 6(*b*), and numeral 85*b* denotes the trailing edge of the original document 85. Numeral 86*a* denotes the leading edge of the copy area 86 and numeral 86*b* a trailing edge of the copy area 86. FIG. 6(*b*) illustrates a case that a leader paper 87 is attached at 87*a* an adhesive part to the leading edge 85*a* of the original document.

If an operator, after depressing the partial copying key 41 to prescribe a partial copying mode (the partial copying mode indicator LED 51 turns to red) and inserting the copysheet (the copysheet insertion indicator LED 60 is put out and the original document insertion indicator LED 61 lights), inserts the original document 85, which is placed on the original document table 5 and into the original document inlet 6 (the partial copying mode indicator LED 61 is put out), transport of the original document 85 starts when the leading edge 85*a* of the original document 85 reaches the first pair of original document feeding rollers 1.

An operator depresses the partial copying key 41 to designate a position to start copying, when the leading edge 86*a* of the copy area 86 of the original document 85 reaches the predetermined position 6*b* (FIG. 1), a position at which an extension of a line from an operator's eyes to an edge and guide 6*a* of an upper cover for the original document inlet 6 arrives (as indicated by a dash line in FIG. 1). Similarly, the operator depresses the partial copying key 41 again when the trailing edge 86*b* of the copy area 86 reaches the same position 6*b*, to designate a position to terminate copying. If the position of the upper cover for the original document inlet 6 is lowered toward the original table 5 and is made of a transparent plate having a mark, it becomes easier for an operator to time when the leading edge 86*a* or the trailing edge 86*b* of the copy area 86 reaches the predetermined position 6*b*, and precise designation of copying start and end positions may be facilitated.

As described above, since an image carrying surface of the original document 85 faces upwards when the original document 85 passes through the position 6*b*, an operator can designate easily and precisely the positions to start and terminate copying in accordance with the leading edge 86*a* and the trailing edge 86*b* of the copy area 86 respectively.

However, since an image carrying surface of an original document needs to face downwards when the original document passes the exposure position, the original document has to be turned over (180° degrees), and therefore, it is impossible to bring the position 6*b* close to the first pair of original document feeding rollers 1. Therefore, as the position of the leading edge 86*a* of the copy area 86 becomes closer to the leading edge 85*a* of the original document 85, designation of a position to start copying in accordance with the leading edge 86*a* of the copy area 86 becomes difficult.

In such a case, as shown in FIG. 6(*b*), a leader paper 87 having an adhesive part 87*a* on one end is detachably attached to the leading edge 85*a* of the original document 85. The length of the leader paper 87 is longer than a distance from the position 6*b* to the first pair of original document feeding rollers 1, and the width is the same as the original document 85. Further, adhesive force of the adhesive part 87*a* is made relatively weak so that the leader paper 87 can be detached easily from the original document 85. Designation of a position to start copying in accordance with the leading edge 85*a* of the copy area 86 becomes easier by attaching such a leader paper to a leading edge of an original document, even if the leading edge 86*a* of the copy area 86 is in close vicinity to the leading edge 85*a* of the original document 85.

Figure 7:
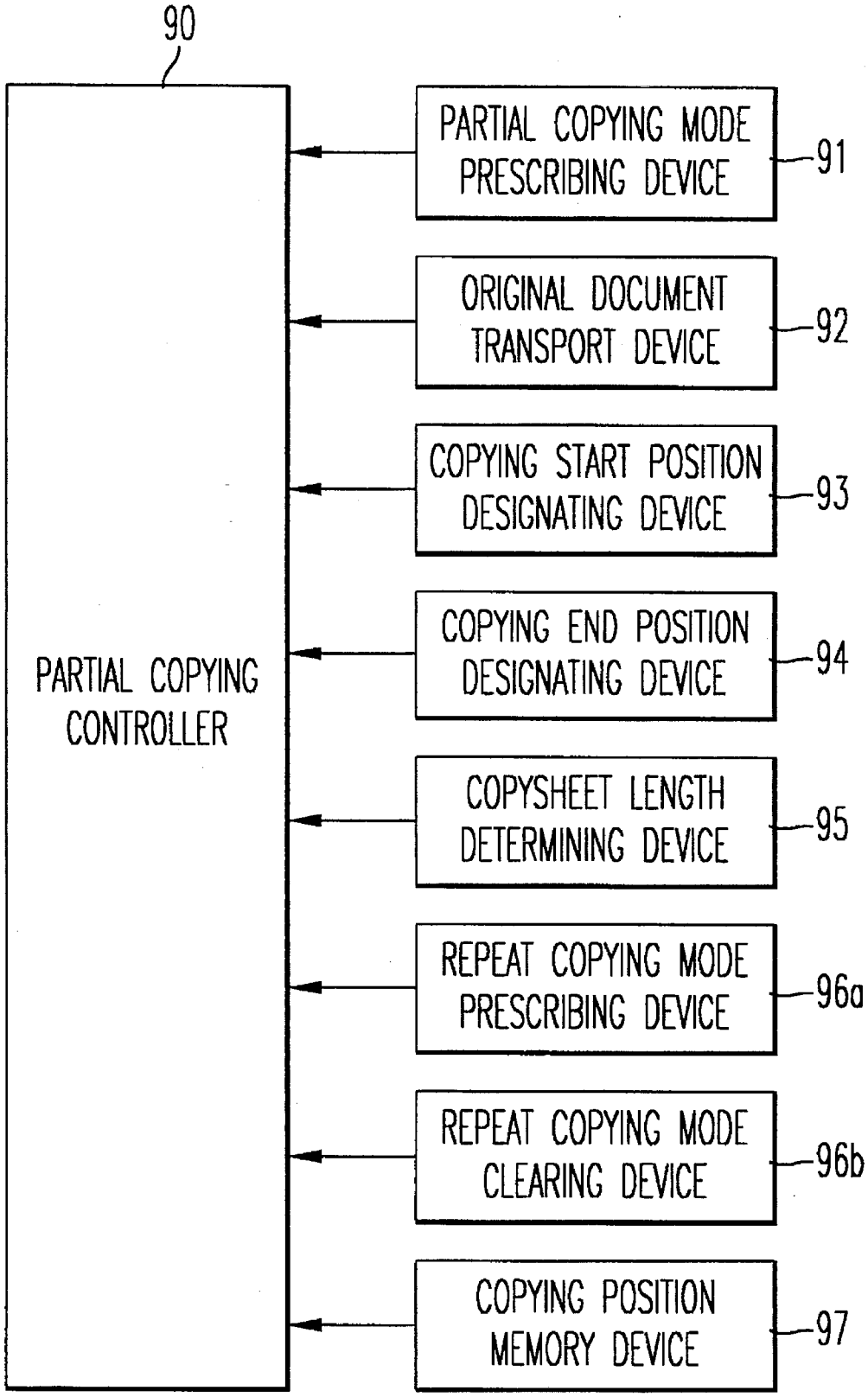
FIG. 7 is a functional block diagram illustrating an example of a structure of a second embodiment of a partial copying control system of the copying machine shown in FIG. 1.

FIG. 7 is a functional block diagram illustrating an example of a structure of a second embodiment of a partial copying control system of the copying machine shown in FIG. 1, and the partial copying control system includes, in addition to the elements shown in FIG. 4, a repeat copying mode prescribing device 96*a* to prescribe a repeat copying mode to memorize a copying start position or both copying start and end positions which are once designated and repeat an operation of partial copying with the same copying start position or copying start and end positions which are memorized, a repeat copying mode clearing device 96b to clear such a repeat copying mode and a copying position memory device 97, including the RAM 74, to memorize copying start and end positions which are designated with the copying start position designating device 93 and the copying end position designating device 94.

Figure 8:
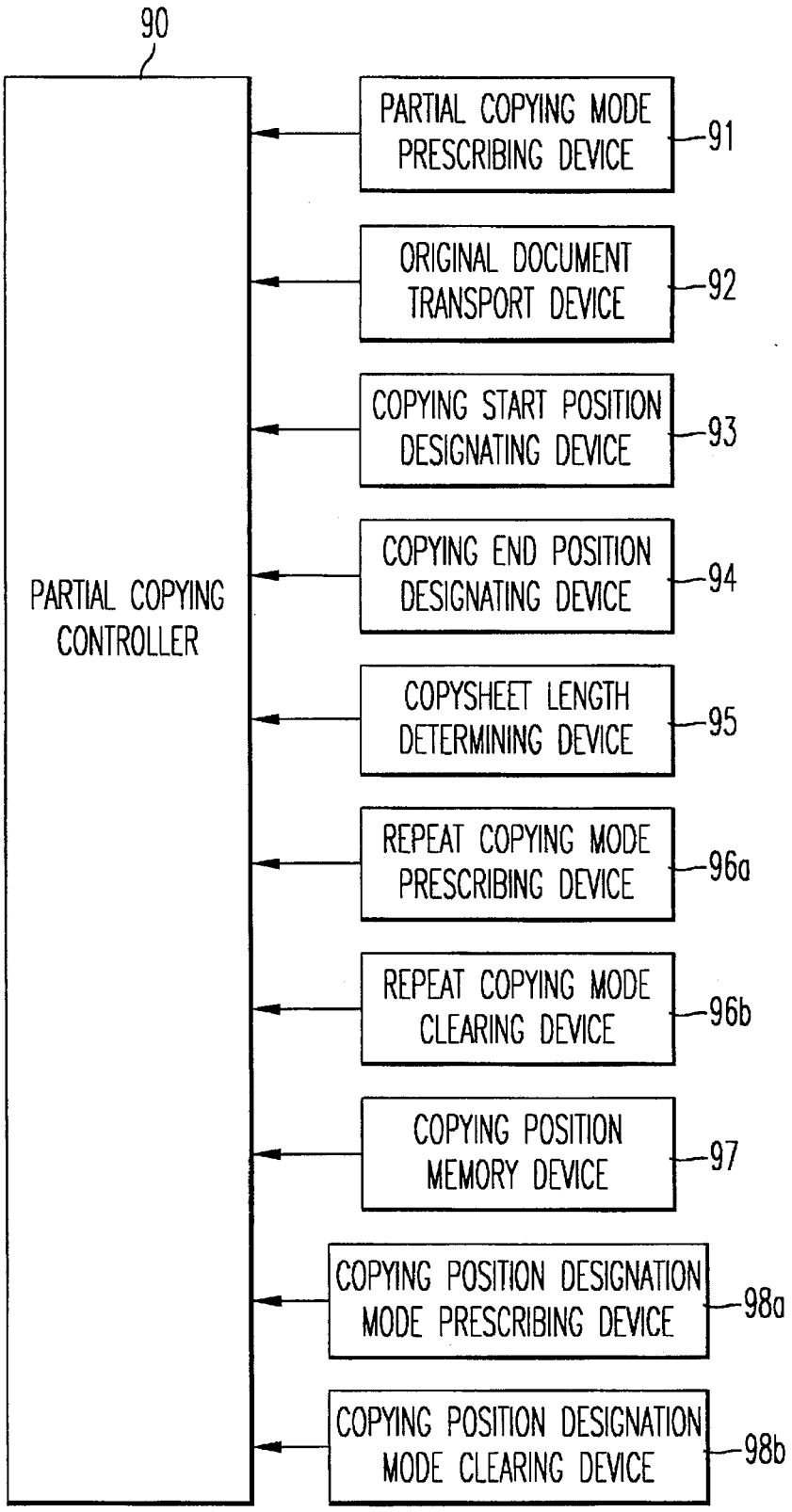
FIG. 8 is a functional block diagram illustrating an example of a structure of a third embodiment of a partial copying control system of the copying machine shown in FIG. 1.

FIG. 8 is a functional block diagram illustrating an example of a structure of a third embodiment of a partial copying control system of the copying machine shown in FIG. 1. The partial copying control system includes, in addition to the elements shown in FIG. 7, a copying position designation mode prescribing device 98a to prescribe a copying position designation mode to designate copying start and end positions and a copying position designation mode clearing device 98b to clear such a copying position designation mode.

The program key 42 of the operational panel 40 shown in FIG. 2 functions as the repeat copying mode prescribing device and also as the repeat copying mode clearing device to clear such a repeat copying mode. Further, the program key 42 functions as the copying position designating mode prescribing device and also as the copying position designation mode clearing device.

Figure 9:
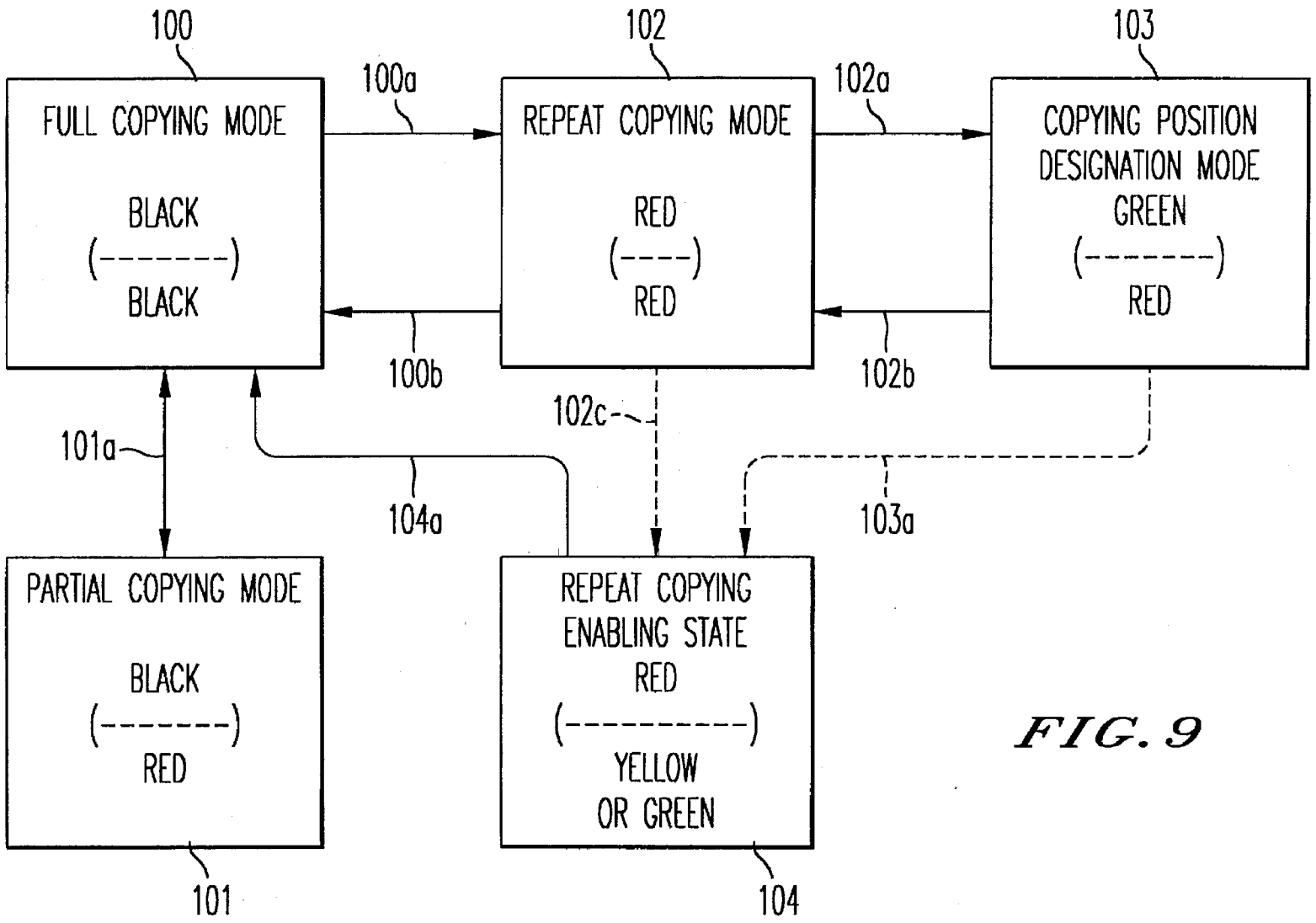
FIG. 9 is a state block diagram showing an example of changing a mode among each mode through an operation of the partial copying key or the program key.

FIG. 9 is a state diagram showing an example of changing a mode among each mode through operations of the partial copying key 41 and the program key 42. Each emitting color of the partial copying mode indicator LED 51 and the program mode indicator LED 52 is indicated respectively in an upper column and a lower column in a parenthesis in a block for each mode. Black indicates that the light is turned off.

As shown in FIG. 9, if no original document is inserted, depression of the partial copying key 41 switches between a partial copying mode 101 and a full copying mode 100 as shown by double headed arrow 101a. Depression of the program key 42 switches among the full copying mode 100 (100a for prescribing and 100b for clearing), a repeat copying mode 102 (102a for prescribing and 102b for clearing) and a copying position designation mode 103.

Namely, when the partial copying key 41 is depressed in the full copying mode 100 (both the program mode indicator LED 52 and the partial copying mode indicator LED 51 are off), the partial copying key 41 functions as the partial copying mode prescribing device and the full copying mode 100 changes (101a) to the partial copying mode 101 (the partial copying mode indicator LED 51 changes to red). If the partial copying key 41 is depressed again, the partial copying key 41 functions as the partial copying mode clearing device and the partial copying mode 101 returns to the full copying mode 100 (the partial copying mode indicator LED 51 turns off).

If the program key 42 is depressed in the full copying mode 100 (both the program mode indicator LED 52 and the partial copying mode indicator LED 51 are off), the program key 42 functions as the repeat copying mode prescribing device and the full copying mode 100 changes (100a) to the repeat copying mode 102 (both the program mode indicator LED 52 and the partial copying mode indicator LED 51 turns to red). If the program key 42 is depressed again, the key 42 functions as the copying position designation mode prescribing device and the repeat copying mode 102 changes (102a) to the copying position designation mode 103 (the program mode indicator LED 52 turns to green).

If the program key 42 is depressed in the copying position designation mode 103, the program key 42 functions as the copying position designation mode clearing device and the copying position designation mode 103 returns (102b) to the repeat copying mode 102 (the program mode indicator LED 52 returns to red). If the program key 42 is depressed again, the key 42 functions as the repeat copying mode clearing device and the repeat copying mode 102 returns (102b) to the full copying mode 100 (both LEDs return to off).

If the copysheet and the original document are inserted respectively in the repeat copying mode 102 and the copying start position and the copying end position are designated respectively via the partial copying key 41 (the partial copying mode indicator LED 51 changes to yellow when the copying start position is designated and to green when the copying end position is designated), the repeat copying mode 102 turns (102b) to a repeat copying enabling state 104, and partial copying thereafter is automatically repeated in accordance with the designated copying start and end positions.

If an original document is inserted and copying start and end positions are designated via the partial copying key 41 in the copying position designation mode 103 (the partial copying mode indicator LED 51 changes to yellow and green respectively) the copying position designation mode 103 is cleared upon designation of the copying end position or detection of a trailing edge of the original document (the program mode indicator LED 52 turns to red), and the mode returns (103a) to the repeat copying enabling state 104.

If the program key 42 is depressed in the repeat copying enabling state 104, the program key 42 functions as the repeat copying mode clearing device and the mode returns (104a) to the full copying mode 100.

If the mode clear key 47 is depressed, the mode is initialized, namely, the mode returns to the full copying mode 100, which is prescribed as an initial mode, and at the same time, all of the other conditions prescribed by the operator, such as designation of copy margin and copy density, are cleared also.

Figure 10:
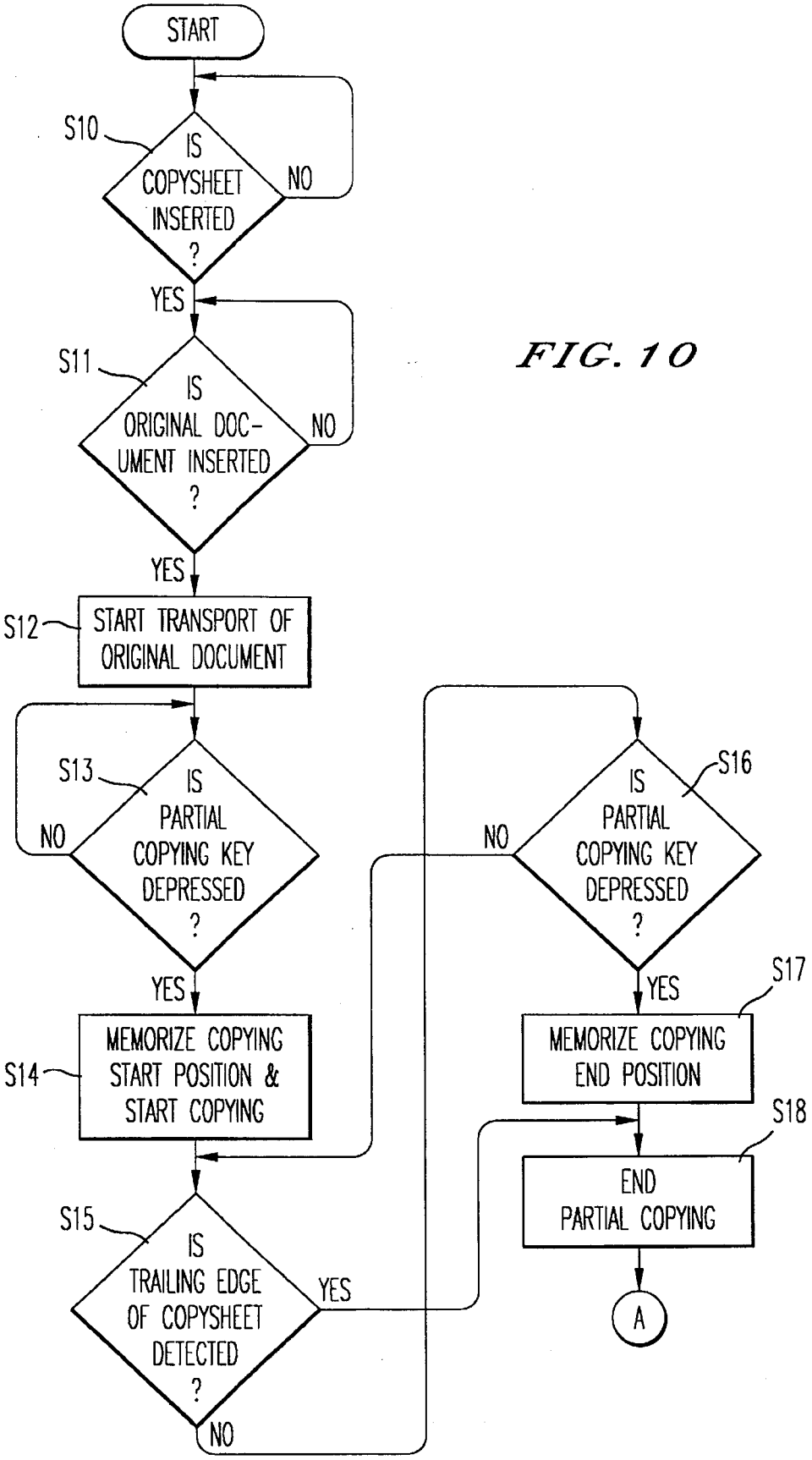
FIG. 10 is a flowchart illustrating a process of partial copying for a first copy performed by the second embodiment of the partial copying control system.
Figure 11:
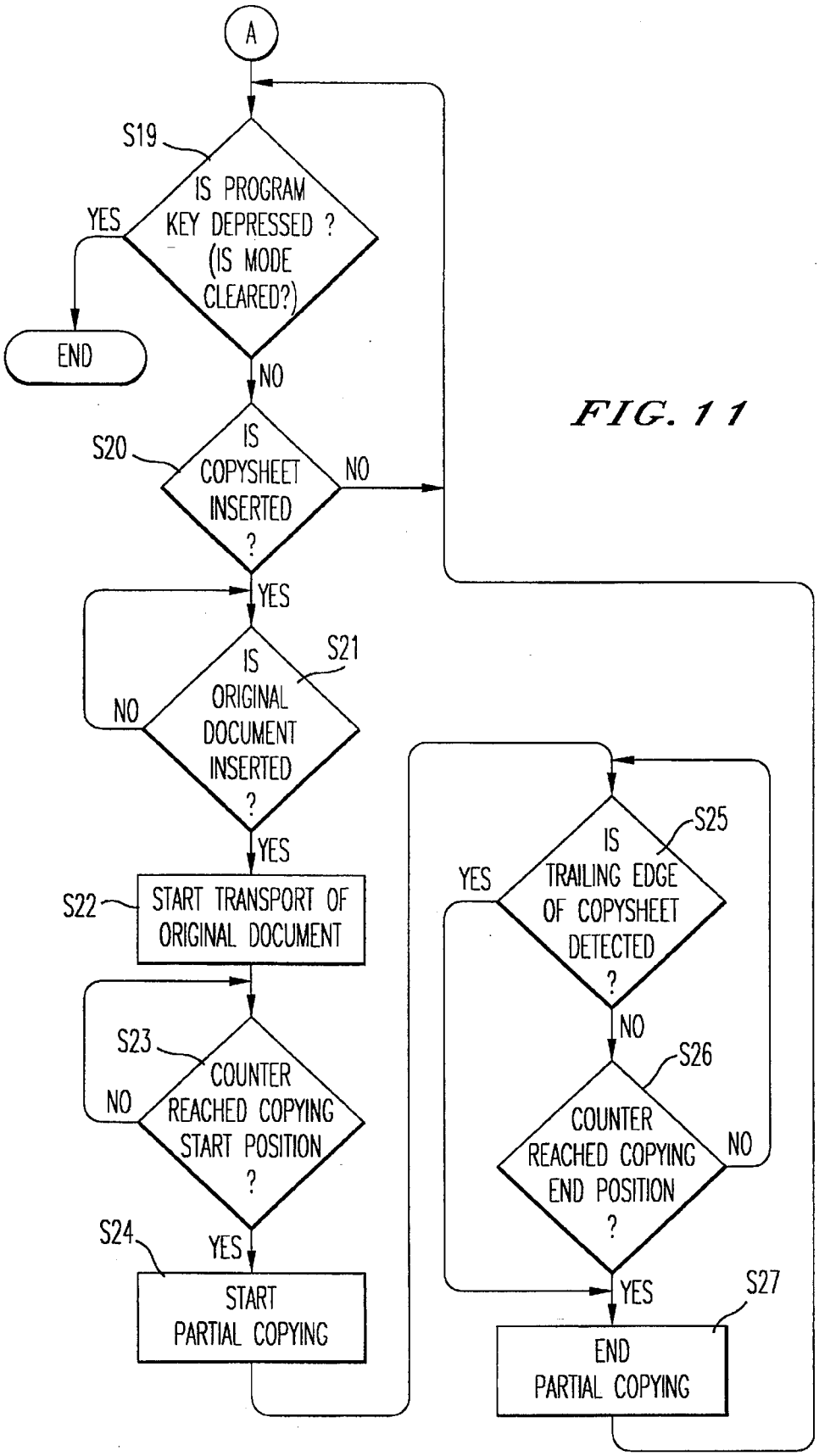
FIG. 11 is a flowchart illustrating a process of partial copying for copying a second and a set of following original documents in a repeat copying mode performed by the second embodiment of the partial copying control system.

FIGS. 10 and 11 are flowcharts illustrating respectively a process of partial copying performed by the CPU 71 as the partial copying controller of the partial copying control system, which is shown in FIG. 7 as an example of the second embodiment of the present invention.

FIG. 10 is a flowchart illustrating a process of partial copying for a first copy, which includes a process of memorizing positions of starting and ending copying, and FIG. 11 is a flowchart illustrating a process of partial copying for the second and following copies, which is performed in accordance with the copying start and end positions memorized in the first partial copying cycle.

The process shown in FIG. 10 starts when the mode is changed to the repeat copying mode 102, for example, when the program key 42 is depressed in the full copying mode 100, as shown in FIG. 9.

First, a step S10 waits for a copysheet to be inserted, and if a copysheet is inserted (the copysheet insertion indicator LED 60 is put out and the original insertion indicator LED 61 lights), the process proceeds to a step S11 to wait for an original document to be inserted.

If an original document is inserted (the original insertion indicator LED 61 is put out), a step S12 starts transport of the original document and a counter, which is not shown, starts counting a series clock pulses of a system clock to memorize a position of the original document being transported as a count value. A step S13 waits for an input from the partial copying key 41 for designating a copying start position. If the step S13 detects the input from the partial copying key 41, the process proceeds to a step S14 where the RAM 74 memorizes (stores) a count value corresponding to the timing sequence of the input as a designated copying start position (the partial copying mode indicator LED 51 turns to yellow) and start partial copying.

Next, the process proceeds to a loop beginning with a step S15 for detecting the trailing edge of the copysheet and a step S16 for detecting the input from the partial copying key 41 for designating the copying end position. If the step S15 detects the trailing edge of the copysheet, the process jumps to a step S18, and if the step S16 detects the input from the partial copying key 41, a step S17 memorizes the copying end position (the partial copying mode indicator LED 51 changes to green). Then, the step S18 terminates the partial copying (the copysheet insertion indicator LED 50 lights), the mode returns to the repeat copying enabling state 104, and the process continues to the process flow shown in FIG. 11.

The process shown in FIG. 11 first proceeds to a beginning of a loop starting at step S19 for detecting clearance of the repeat copying mode 102 via the program key 42 and a step S20 for detecting insertion of a next copysheet. If the step S19 detects clearance of the repeat copying mode 102, the mode returns to the full copying mode 100 and the process ends. If the step S20 detects insertion of the next copysheet, a partial copying process for the second and following copies starts and a step S21 waits for insertion of an original document (which may be the first original document that is to be copied once again or a second and a set of following original documents to be copied. For example, the second and following documents could be additional pages of the original document.).

If an original document is then inserted, a step S22 starts transport of the original document and the counter starts counting a clock pulse of the system clock, and a step S23 determines if the counter reaches a count value which is memorized as a designated copying start position. If the step S23 determines as that the counter reaches the count value memorized as a designated copying start position, the process proceeds to a step S24 to start partial copying.

Next, the process proceeds to a loop beginning at step S25 for detecting the trailing edge of the copysheet and a step S26 for determining if the counter reached a count value memorized as the designated copying end position. If the step S25 detects the trailing edge of the copysheet, the process jumps to a step S27, and if the step S26 determines that the counter reaches the count value memorized as a copying end position, the process proceeds to the step S27, to terminate the partial copying respectively and to return to the step S19.

As explained above, in this second embodiment, if the repeat copying mode 102 is prescribed, copying start and end positions which are designated in the first cycle of partial copying are memorized. Therefore, once copying start and end positions are designated in the first cycle of partial copying, partial copying for copying the second and the set of following original documents are performed automatically with the same copying start and end positions, until the repeat copying mode is cleared, by just inserting the copysheet and the original document into the copysheet inlet 26 and the original document inlet 6 respectively.

Therefore, when making a plurality of copies of one original document, designation of copying start and end positions for the second and following copies are not necessary and the operation is simplified. Furthermore, by checking in the first cycle of partial copying if copying start and end positions are designated correctly, it can be avoided that the copying start or end position is mistakenly designated at a different position by mistake for some of the plurality of copies consequently producing a copy carrying an image of a copy area which is different from the desired copy area. Thus, if positions of leading and trailing edges of each copy area are identical among a plurality of original documents, partial copying for such a plurality of original document is performed similarly, without requiring designation of copying start and end positions for each of the plurality of original documents.

Figure 12:
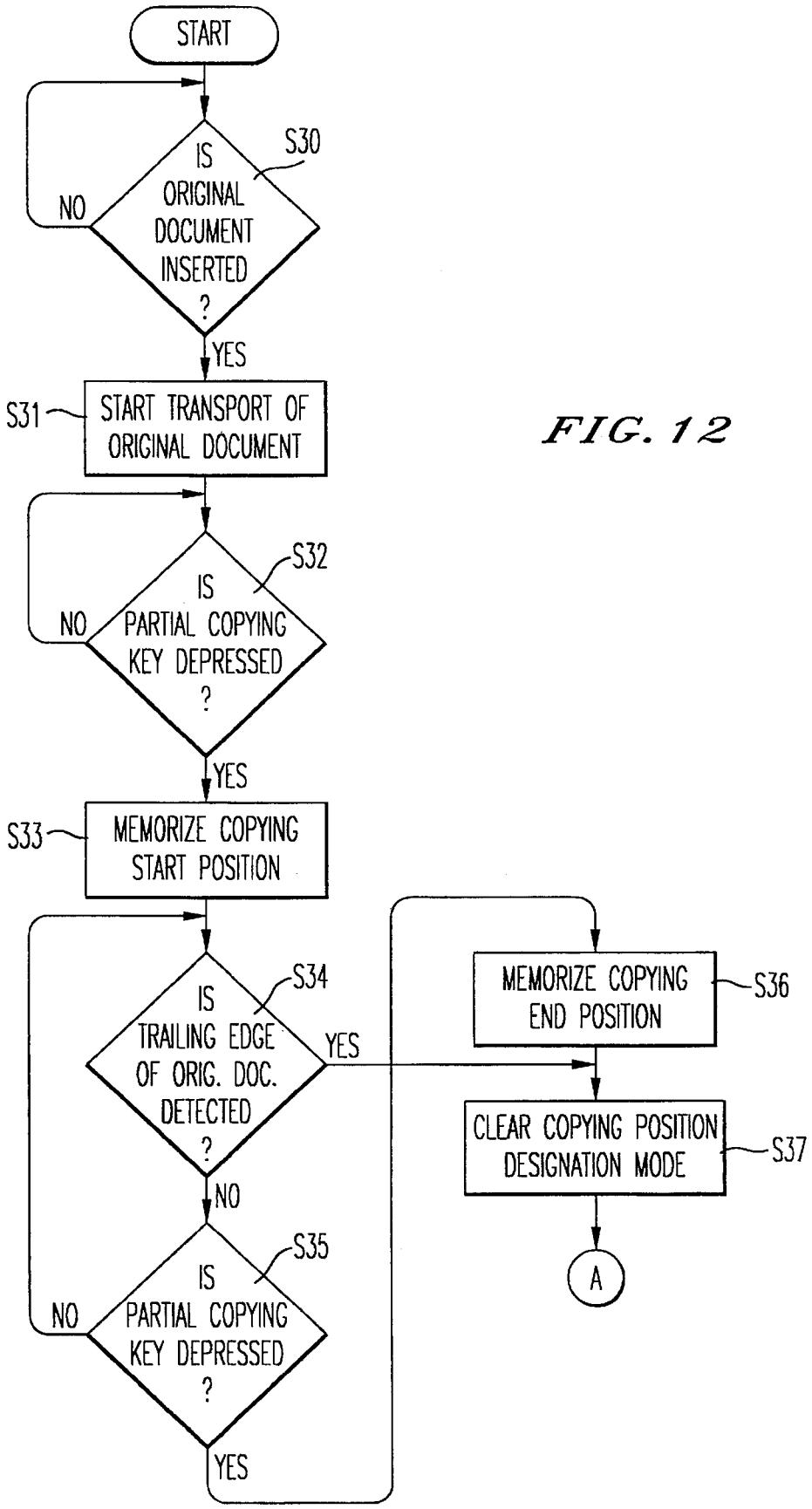
FIG. 12 is a flowchart illustrating a process of partial copying in a copying position designation mode performed by the third embodiment of the partial copying control system.

FIG. 12 is a flowchart illustrating a process of designating copying start and end positions in a copying position designation mode, performed by the CPU 71 as the partial copying controller of the partial copying control system, as an example of the third embodiment of the invention.

The process shown in FIG. 12 starts when the mode is changed to the copying position designation mode 103, for example, by depressing the program key 42 twice in the full copying mode 100. When the process starts, the program mode indicator LED 52 lights in green, the partial copying mode indicator LED 51 lights in red, both the copysheet insertion indicator LED 60 and the original insertion indicator LED 61 light, and the copying position designation can be started by inserting an original document even if a copysheet is not inserted.

If the process of the copying position designation mode starts, as described as above, first a step S30 waits for insertion of an original document. If the original document inlet sensor 8 detects insertion of an original document (the original document insertion indicator LED 61 is put out), the first and second pairs of original document feeding rollers 1 an 2 start to rotate at a normal speed or at a prescribed speed which is slower than the normal speed, for example, at a speed of about 2 cm/sec in a case that the normal speed is about 20–30 cm/sec.

When a leading edge of the original document reaches the first pair of original document feeding rollers 1, a step S31 starts to transport the original document at the prescribed speed, and when the original document registration sensor 9 detects a starting of the original document transport, the counter (not shown in the drawings), starts counting a series of clock pulses of the system clock to memorize each position designated as a copying start position or end position, and copying start and end positions are memorized respectively as a count value of the counter.

A frequency of the system clock is set in proportion to a speed of original document transport, and therefore, the clock frequency in the first partial copying cycle and the second and following partial copying cycles in the second embodiment are the same. In this third embodiment, however, the clock frequency in the copying position designation mode is made slower, for example, to 1/10 to 1/15 of that in the first partial copying cycle.

A step S32 waits for an input instruction designating a copying start position, and if the instruction is provided, a step S33 stores into the RAM 74 a count value of the counter corresponding to the timing sequence of the input as a designated copying start position (the partial copying mode indicator LED 51 changes to yellow). Then, the process proceeds to a loop at a step S34 for determining if a trailing edge of the original document is detected by the original document registration sensor 9 and a step S35 for determining if an input of an instruction for designating a copy end position is provided from the partial copying key 41. If in the step S34 the trailing edge of the original document is detected, the process jumps to a step S37 judging as that no instruction for designating a copying end position has been inputted.

If the step S35 detects an instruction for designating a copying end position, a step S36 stores into the RAM 74 a count value corresponding to the input timing sequence as a designated copying end position (the partial copying mode indicator LED 51 turns to green) and a step S37 clears the copying position designation mode (the program mode indicator LED 52 turns to red) to return to the repeat copying enabling state 104. Thereafter, the process continues to the process shown in FIG. 9 to perform partial copying in a repeat copying mode.

In a case of a copying machine with a relatively slow speed of transporting the original document, such as, for example, 2 cm/sec, it is relatively easy to accurately designate a copying start position or a copying end position. However, if the normal speed for transporting an original document is relatively fast, such as, for example, 20–30 cm/sec, it is almost impossible to designate precisely a copying start position or a copying end position. Therefore, this third embodiment provides a copying position designation mode with which an original document transport speed is slowed to around 2 cm/sec so that designation of copying start and end positions can be made precisely.

In this embodiment, minimal manual intervention is required and results in an operator-friendly copying process. For instance, a copying position designation mode is cleared automatically either upon detection of an input instruction for designating a copying end position or upon detection of the trailing edge of the original document being transported at a prescribed speed. Therefore, an operator does not have to clear a copying position designation mode, and there occurs no trouble even when an operator fails to clear the copying position designation mode.

Furthermore, even when designation for a copying end position is not necessary or an operator forgets to designate a copying end position, the copying position designation mode is cleared securely upon detection of the trailing edge of an original document. Further, if the copying position designation mode is cleared in accordance with a designated copying end position, a part of the original document after the designated copying end position is transported at a normal speed, and therefore, it is avoided to take a long time for exiting a long original document.

Additionally, a time required in the copying position designation mode for designating copying start and end positions may be shortened by prescribing two steps of an original document transport speed, a first speed which is slower than the normal speed and a second speed which is further slower than the first speed, and including in the partial copying key 41 a function to switch between these two speeds. Namely, a first speed may be set to a speed with which an operator can recognize that the leading edge or the trailing edge of the copy area is approaching the predetermined position 6*b* (FIG. 1), such as for example, a speed of about 4–5 cm/sec, and a second speed at a speed with which an operator can designate a copying start or a copying end position precisely, such as for example, a speed of about 1 cm/sec. In a copying position designation mode, an original document is transported at the first speed if the partial copying key 41 is not being depressed, and at the second speed if the partial copying key 41 is being depressed, respectively. Once an operator recognizes that the leading edge or the trailing edge of the copy area in the original document is approaching the predetermined position 6*b*, the operator depresses the partial copying key 41 to change the transport speed to the second speed and continues to depress the partial copying key 41 until the leading edge or the trailing edge of the copy area reaches the predetermined position 6*b*.

When the leading edge of the copy area reaches the predetermined position 6*b*, the operator releases the partial copying key 41, and a count value of the counter corresponding to the position where the depression of the partial copying key 41 is released is memorized as the copying start position, and the original document is transported thereafter at the first speed.

If the partial copying key 41 is depressed for the second time to change the transport speed to the second speed and is then released when the trailing edge of the copy area reaches the predetermined position 6*b*, the position where the partial copying key 41 is released is recognized as the copying end position and the copying position designation mode is cleared at the same time. Therefore, a part of the original document after the copying end position is transported at the normal speed. Thus, especially in a case of an original document having a long length, a period of time to transport the original document is shortened by transporting at the first speed a part of an original document from the leading edge of the original document to the leading edge of the copy area and by transporting at the normal speed a part of the original document from the trailing edge of the copy area to the trailing edge of the original document. Further, precise designation of copying start and end positions are realized by transporting the original document at the second speed when designating the start and end positions.

In the third embodiment, the program key 42 is used also as the repeat copying mode prescribing device and the copying position designation mode prescribing device, and therefore, the mode is changed to the copying position designation mode 103 via the repeat copying mode 102 as shown in FIG. 9. However, even if the repeat copying mode prescribing device and the copying position designation mode prescribing device are separately provided, it is apparent that the operation is simplified if the copying position designation mode prescribing device is so made to function to prescribe the repeat copying mode.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A copying machine configured to copy a designated area of an original document, comprising:

an exposure position;

an original document scanning feed through system comprising, means for transporting the original document through the exposure position;

means for prescribing a partial copying mode to copy a designated area of at least one surface of the original document, said designated area comprising a copying start position and a copying end position;

means for enabling an operator to designate the copying start position while the original document is transported by said original document transport means and when said original document reaches a first predetermined position;

means for enabling an operator to designate the copying end position while the original document is transported by said original document transport means and when the original document reaches a second predetermined position; and means for controlling a partial copy operation including controlling when to start and stop copying a first image from the first original document to a second medium in accordance with a timing sequence corresponding to when the copying start position was designated and when the copying end position was designated, so that the designated area of original document is copied to the second medium.

2. The copying machine of claim 1, further comprising:

means for prescribing a repeat copying mode to repeat copying a second and a set of following original documents using the same designated area prescribed for the original document;

means for storing the designated copying start position and the designated copying end position; and said controlling means controlling when to start and stop copying a corresponding designated area of the second and the set of following original documents to another media in accordance with the timing sequence correspondence to the copying start position and the copy end position stored in and read from the storing means, so that the respective designated areas of the second and set of following original documents are copied to the another media.

3. The copying machine of claim 2, wherein said original document comprises said second and said set of following original documents such that the copying machine makes multiple copies of the original document.

4. The copying machine according to claim 1, further comprising:

a guide member provided upstream of said exposure position in an original document transport direction and configured to indicate said first and second predetermined positions; and said original document transport means transporting the original document with the at least one surface to be copied facing upwards when the original document passes under said guide member.

5. The copying machine in accordance with claim 1, wherein the means for transporting is configured to transport the original document with the at least one surface to be copied being visible to an operator when the original document passes said first and second predetermined positions.

6. The copying machine according to claim 1, further comprising:

means for prescribing a copying position designation mode which changes an original document transport speed of said original document transport means to a speed slower than a speed of a normal copying operation.

7. The copying machine according to claim 6, further comprising:

means for prescribing and for clearing a copying position designation mode in accordance with a timing sequence corresponding to designating the copying end position; and means for restoring the original document transport speed of said original document transport means to the speed of the normal copying operation.

8. The copying machine according to claim 5, further comprising:

means for detecting a trailing edge of the original document being transported by said original document transport means; and means for clearing the copying position designation mode in accordance with a timing sequence corresponding to detecting the trailing edge of the original document.

9. A copying machine configured to copy a designated area of an original document, comprising:

an exposure position;

an original document scanning feed through system comprising, means for transporting a first original document through the exposure position;

a copysheet trailing edge detector;

means for prescribing a partial copying mode to copy the designated area of the first original document;

means for enabling an operator to designate a copying start position while the first original document is transported by said original document transport means and when said first original document reaches a predetermined position; and means for controlling a partial copying operation including controlling when to start copying the first original document to a copysheet in accordance with a first timing sequence corresponding to when the copying start position was designated and ending copying in accordance with a second timing sequence corresponding to when a trailing edge of the copysheet is detected with said copysheet trailing edge detector.

10. The copying machine of claim 9, further comprising:

means for storing the designated copying start position designated by said enabling means;

means for prescribing a repeat copying mode to repeat copying for a second and a set of following of original documents using the same designated area prescribed for the first original document; and wherein said means for controlling a partial copying operation comprises means for controlling when to start copying of the second and the set of following original documents in accordance with the copying start position stored in said storing means and read out from said storing means, and ending copying in accordance with the second timing sequence corresponding the trailing edge of the transported copysheet detected by the copysheet trailing edge dectector.

11. The copying machine of claim 9, further comprising:

means for determining a length of a transported copysheet;

said controlling means including, means for determining if a length of an area designated by said copying start position designating means and said copying end position designating means is shorter than the length of the transported copysheet determined by said copysheet trailing edge detector, and means for controlling when to start and stop copying the second and the following original documents in accordance with the copying start and the copying end positions stored in and read out from said storing means if the length of the designated area is shorter than the length of the transported copysheet, and in accordance with detecting the trailing edge of the transported copysheet if the length of the transported copysheet is shorter than the length of the designated area.

12. A method for copying a designated area of an original document, comprising:

transporting the original document positioned with a surface to be copied face-up, designating a copying start position when a leading edge of an area to be copied in the original document reaches a predetermined position as transported by said transporting step;

storing said copying start position into a first memory portion;

starting a first copying operation in accordance with a first timing sequence corresponding to said copying start position;

designating a copying end position when a trailing edge of an area to be copied in the original document reaches a predetermined position as transported by said starting transport step;

storing said copying end position into a second memory portion;

ending a copying operation in accordance with a second timing sequence corresponding to said copying end position; and copying the designated area to a second medium.

13. The method of claim 12 further comprising the steps of:

transporting a next original document;

starting a second copying operation in accordance with the first timing sequence corresponding to the stored copying start position;

ending the second copying operation in accordance with the second timing sequence corresponding to the stored copying end position; and copying the designated area from the second original document to the second medium.

14. A method for copying a designated area of an original document, comprising:

transporting the original document at a first speed slower than a normal speed of a normal copying operation;

designating a copying start position when a leading edge of an area to be copied in an original document reaches a predetermined position as transported by said transporting step;

storing said copying start position into a first memory portion;

designating a copying end position when a trailing edge of an area to be copied in the original document reaches a predetermined position as transported by said transport step;

storing said copying end position which is designated into a second memory portion;

starting transport of a next original document at the speed of the normal copying operation;

starting a copying operation in accordance with said stored copying start position; and ending the copying operation in accordance with said stored copying end position.

* * * * *